US012546195B1

(12) United States Patent
Guedes

(10) Patent No.: US 12,546,195 B1
(45) Date of Patent: Feb. 10, 2026

(54) DISCRETE PERFORATING DEVICE

(71) Applicant: Schlumberger Technology Corporation, Sugar Land, TX (US)

(72) Inventor: Carlos Eduardo Guedes, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/050,876

(22) Filed: Feb. 11, 2025

(51) Int. Cl.

| | |
|---|---|
| ***E21B 43/118*** | (2006.01) |
| ***E21B 43/1185*** | (2006.01) |
| ***E21B 43/119*** | (2006.01) |
| ***E21B 47/09*** | (2012.01) |

(52) U.S. Cl.
CPC ..... *E21B 43/118* (2013.01); *E21B 43/1185* (2013.01); *E21B 43/119* (2013.01); *E21B 47/09* (2013.01); *E21B 2200/08* (2020.05)

(58) Field of Classification Search
CPC .. E21B 43/118; E21B 43/1185; E21B 43/119; E21B 47/09; E21B 2200/08
See application file for complete search history.

(56) References Cited

U.S. PATENT DOCUMENTS

| | | | | |
|---|---|---|---|---|
| 12,291,945 | B1 * | 5/2025 | Ang | E21B 43/117 |
| 2006/0102352 | A1 * | 5/2006 | Walker | E21B 43/119 175/4.6 |
| 2009/0114382 | A1 * | 5/2009 | Grove | E21B 43/117 166/63 |
| 2009/0151588 | A1 * | 6/2009 | Burleson | E21B 43/119 175/4.53 |
| 2020/0199957 | A1 * | 6/2020 | Bertoja | E21B 23/00 |
| 2020/0392819 | A1 * | 12/2020 | Robey | E21B 43/1195 |
| 2022/0003096 | A1 * | 1/2022 | Winkler | E21B 43/261 |
| 2022/0074289 | A1 * | 3/2022 | Lopez de Cardenas | E21B 43/119 |
| 2023/0009723 | A1 * | 1/2023 | Collins | F42D 1/043 |
| 2023/0203923 | A1 * | 6/2023 | Eitschberger | E21B 43/117 |

* cited by examiner

*Primary Examiner* — James G Sayre
(74) *Attorney, Agent, or Firm* — Jeffrey D. Frantz

(57) ABSTRACT

The present disclosure relates to a discrete perforating device. The discrete perforating device includes a shaped charge having a casing, an explosive component, and a liner member. The discrete perforating device also includes an initiating mechanism configured to activate the explosive component. Further, the discrete perforating device include a housing that encapsulates the shaped charge and the initiating mechanism.

20 Claims, 5 Drawing Sheets

30a
26
28
22
24
20a 30b
26
28
22
24
20b 30c
26
28
22
24
20c 16
18a
12
10a
16
18b
12
10b
16
18c
12
10c

DISCRETE PERFORATING DEVICE

BACKGROUND

The present disclosure generally relates to systems and methods for discrete perforating devices.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Exploring, drilling, and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating, and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. Specifically, shaped charges housed within a steel gun may be detonated to form perforations or tunnels into the surrounding formation, ultimately enhancing recovery therefrom.

The profile, depth, and other characteristics of the perforations are dependent upon a variety of factors in addition to the material structure through which each perforation penetrates. That is, the jet formed by the detonation of a given shaped charge may pierce a steel casing, cement, and a variety of different types of rock that make up the surrounding formation. However, characteristics of different components of the shaped charge itself may determine the characteristics of the jet, and ultimately the depth, profile, and overall effectiveness of each given perforation as described herein.

Among other components, a shaped charge generally includes a case, explosive pellet material, and a liner member. Thus, detonation of the explosive within the case may be utilized to direct the liner away from the gun and toward the well wall as a means by which to form the noted jet. Therefore, the characteristics of the jet are largely dependent upon the behavior of the liner and other shaped charge components upon detonation. For example, a solid copper or zinc liner may be utilized to generate a jet of considerable stretch with a head or tip that travels at 5-10 times the rate of speed as compared to the speed at the tail. Depending on the casing thickness, formation type, and other such well-dependent characteristics, this type of liner is generally of notable effectiveness in terms of achieving substantial depth of penetration.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present disclosure is directed to a discrete perforating device. The discrete perforating devices includes a shaped charge having a casing, an explosive component, and a liner member. The discrete perforating device also includes an initiating mechanism configured to initiate detonation of the explosive component of the shaped charge. Further, the discrete perforating device include a housing that encapsulates the shaped charge and the initiating mechanism.

In one embodiment, the present disclosure is directed to a method. The method includes providing a plurality of discrete perforating devices. Each discrete perforating device has a curved outer surface that encapsulates an explosive component positioned within an interior volume of the housing. Each discrete perforating device also includes an initiating mechanism configured to activate the explosive component. Further, each discrete perforating device includes a directional biasing component configured to cause a respective discrete perforating device to roll along the curved outer surface while downhole.

In one embodiment, the present disclosure is directed to a method. The method includes providing a plurality of discrete perforating devices, wherein each discrete perforating device comprises a housing that holds a shaped charge. The method also includes deploying the plurality of discrete perforating devices within a well. Further, the method includes performing a perforation operation subsequent deploying the plurality of discrete perforating devices within a well.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
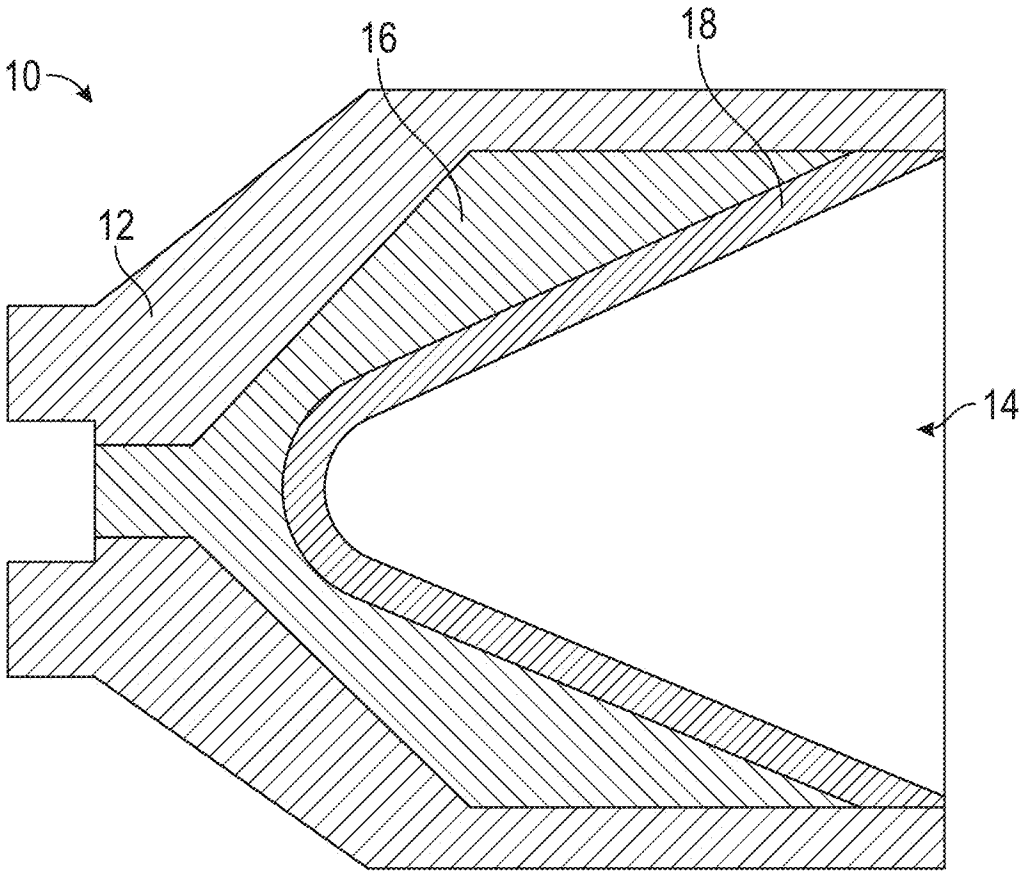
FIG. 1 shows a cross-sectional view of an embodiment of a shaped charge, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

The present disclosure relates to discrete perforating devices (e.g., perforating balls). As referred to herein, "discrete perforating devices" refers to discrete perforating devices that are spatially distinct, not linked, attached, or physically coupled to other perforating devices via an external component, such as a rod, an adhesive, a perforating gun, a chain, and the like. In general, the disclosed discrete perforating devices include a shaped charge, an initiating mechanism (e.g., detonation initiation mechanism), and a housing that encapsulates or otherwise encloses the shaped charge and the initiating mechanism. In certain embodiments, the discrete perforating device can be made by providing a shaped charge within the housing. The housing may be curved (e.g., spherical, cylindrical, ellipsoidal, and otherwise a solid of revolution) such that the discrete perforating device is capable of rotating about one or more axes at least while it is deployed (e.g., in a well). In some instances, the discrete perforating devices may include a directional biasing feature that may cause the discrete perforating devices to rotate while downhole such that the shooting orientation (e.g., direction of travel of the jet) points in a particular direction. In this way, the shooting orientation of the discrete perforating device may be controlled without an external component that fixes the shaped charge in a particular direction.

Figures 2A, 2B, 2C:
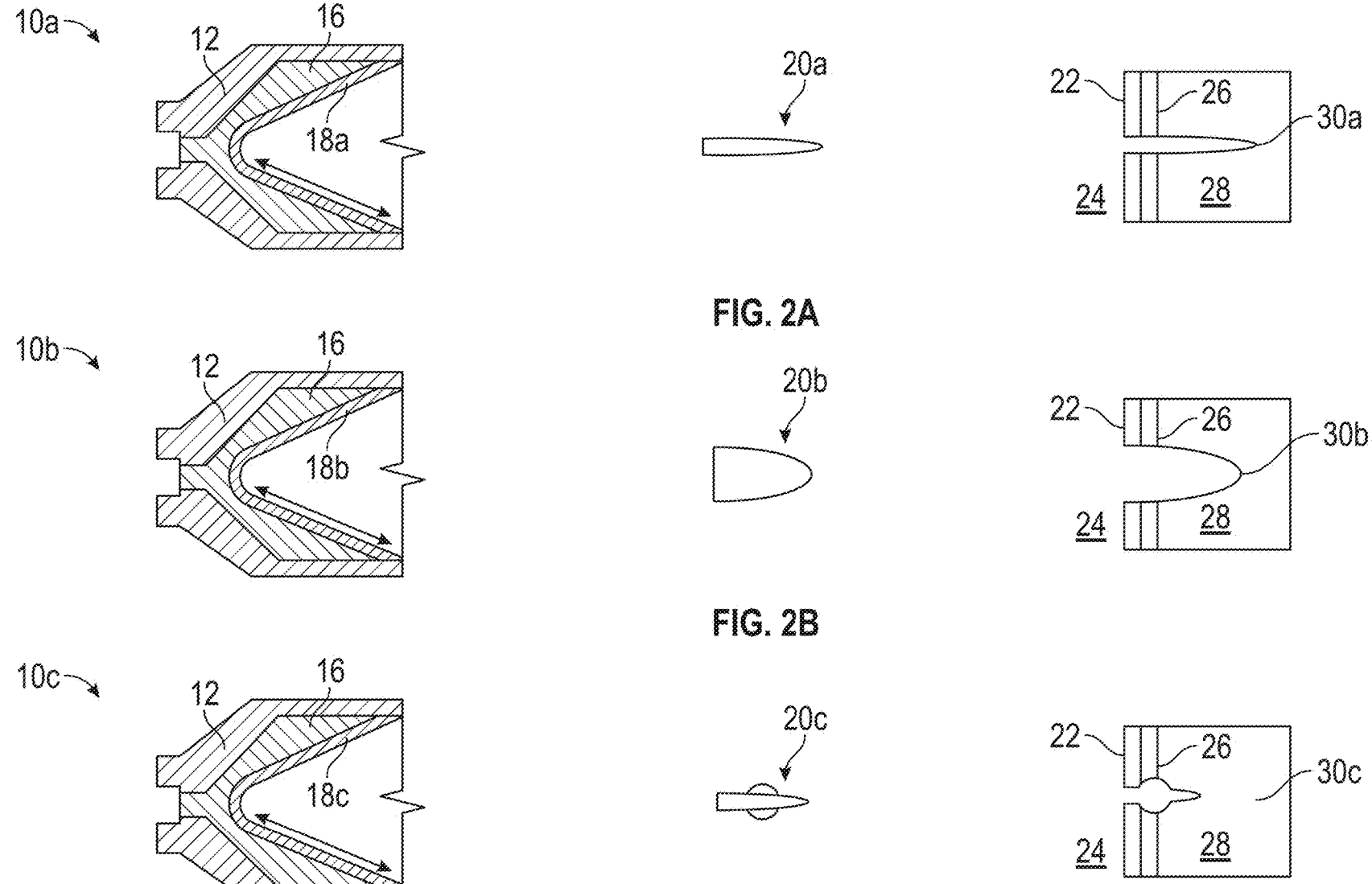
FIG. 2A shows a diagram of the shaped charge of FIG. 1 forming a first type of jet, in accordance with aspects of the present disclosure.
FIG. 2B shows a diagram of the shaped charge of FIG. 1 forming a second type of jet, in accordance with aspects of the present disclosure.
FIG. 2C shows a diagram of the shaped charge of FIG. 1 forming a third type of jet, in accordance with aspects of the present disclosure.

The discrete perforating devices can have a number of different variations of shaped charges to produce jets for producing deep penetration in casing, large diameter holes, and other jets as described in more detail with respect to FIGS. 2A-2C. The shaped charge may include any suitable liners and/or shaped charge designs, such as an energetic liner, a reactive liner, consistent entrance hole shaped charge, good hole shaped charge, and others as understood by one of ordinary skill in the art. In some embodiments, the casing of the shaped charge and the housing of the discrete perforating device may be a unibody structure (e.g., forming a single, unified body). For example, the shaped charge may be built as part of the discrete perforating device itself, by replacing the shaped charge casing and actually having the housing (e.g., ball body) to function as a shaped charge casing, and having the explosives pressed inside the ball body forming a new concept of energetic device. The disclose techniques provide that a device may be deployed into an oilfield well by pumping instead of existing traditional conveyance methods such as: Wireline Perforating, Wireline Pump Down Perforating, Slickline Perforating, Coil Tubing Perforating or Tubing-Conveyed Perforating (TCP). In some embodiments, the initiating mechanism may include a depth correlation device or a chemical activation feature (e.g., pH activation feature). In addition, in some embodiments, the perforating devices may include a directional biasing feature that generally cause the orientation of the perforating device to be aligned in a desired direction.

Referring now to FIG. 1, a cross sectional view of an embodiment of a shaped charge 10 is shown. The shaped charge 10 includes a casing member 12 and an interior volume 14 that is defined by an explosive component 16 and a liner member 18. The explosive component 16 is disposed between the casing member 12 and the liner member 18 such that the liner member 18 surrounds the interior volume 14.

The liner member 18 may be formed of packed, powered metals and, in at least in some instances, non-metallic materials. The metals of the liner member 18 may include metals having a density of approximately 6 or greater grams per cubic centimeter (g/cc), 7 or greater g/cc, 8 or greater g/cc, 9 or greater g/cc, 10 or greater g/cc, 11 or greater g/cc, 12 or greater g/cc, or 13 or greater g/cc, and so on. In some embodiments, the metals of the liner member 18 may include metals having a density less than approximately 6 g/cc (e.g., aluminum, beryllium, titanium, and so on). For example, the liner member 18 may include copper (e.g., having a density of approximately 8.9 g/cc) and/or lead (e.g., having a density of approximately 11.3 g/cc). In some embodiments, the liner member 18 may include tungsten (e.g., having a density of approximately 19.3 g/cc). In some embodiments, the liner member 18 may include a mixture of metals, which may provide a desired density. For example, the liner member 18 may include approximately 50 weight percent (wt %) or greater, approximately 60 wt % or greater, approximately 70 wt % or greater, approximately 80 wt % or greater, or approximately 90 wt % or greater of a first metal (e.g., tungsten). Further, the liner member 18 may include a remaining wt % of a second metal (e.g., copper or lead), such as approximately 10 wt % or less, 20 wt % or less, 30 wt % or less, and so on.

As mentioned above, the liner member 18 may also include non-metallic materials, such as nitrides, carbides, oxides, diamond, ceramic materials, or a combination thereof. For example, the liner member 18 may include relatively low density materials (e.g., as compared to the metals), such as SiC, $Si_3N_4$, $SiO_2$, $B_4C$, $B_4N$, ZnO, TiC, $Li_3N$, $TiO_2$, $Mg_3N_2$, and other relatively low density non-metallic materials. In some embodiments, the liner member 18 may include a polymer material, such as fluorinated polymers (e.g., polytetrafluoroethylene). In some embodiments, the liner member 18 may include metal-polymer composite mixtures. In such embodiments, the liner member 18 may include a first weight percent (wt %) (e.g., first amount) of one or more metals and a second wt % of one or more non-metallic materials. For example, the liner member 18 may include approximately 50 wt % or greater, 60 wt % or greater, 70 wt % or greater, 80 wt % or greater, 90 wt % or greater of one or more metals. As such, the liner member 18 may include approximately 50 wt % or less, 40 wt % or less, 30 wt % or less, 20 wt % or less, or 10 wt % or less of one or more non-metallic materials.

Referring specifically now to FIGS. 2A, 2B, and 2C (e.g., collectively FIGS. 2A-2C), side cross-sectional views of a different types of shaped charges 10*a*, 10*b*, and 10*c* in use during perforating applications are shown. That is, in each case, a shaped charge 10*a*, 10*b*, and 10*c* has been loaded into a perforating gun (not shown), and utilized in a perforating application in a well. The charges 10*a*, 10*b*, and 10*c* may be made up of generally the same features described with respect to FIG. 1. For example, the charges 10*a*, 10*b*, and 10*c* may include the same type of casing member 12 and explosive component 16. However, in each case, a different type of liner member 18*a*, 18*b*, and 18*c* may be used to provide a different type of charge 10*a*, 10*b*, and 10*c* for a different type of perforating application.

With reference to FIG. 2A in particular, a deep penetrating jet shaped charge 10*a* is shown. Upon detonation, a deep penetrating jet 20*a* is formed and directed at the casing 22 that defines the well 24. Ultimately, this forms a perforation tunnel 30*a* that penetrates through the casing 22, cement 26, and into the adjacent formation 28 so as to aid in hydrocarbon recovery therefrom. In the embodiment shown, the liner member 18*a* that is used to form the jet 20*a* and achieve such penetration may be a comparatively thin but high-density tungsten-based liner member 18*a* so as to form a thinner and longer jet 20*a*. The end result, depending largely on the particular characteristics of the casing 12, may be a perforation tunnel 30*a* of between approximately 30 and approximately 40 inches deep with a diameter of between approximately 0.3 inches and approximately 0.4 inches.

Of course, as depicted in the embodiment of FIG. 2B, a different type of liner member 18*b* may be utilized to obtain a different type of charge 10*b* and performance during perforation. More specifically, in the embodiment of FIG. 2B, a side cross-sectional view of wide jet shaped charge 10*b* is shown. In this case, the liner member 18*b* is of a comparatively thicker dimensions and lower density, perhaps with a lower percentage of tungsten. Thus, a comparatively thicker or wider jet 20*b* may be formed. The end result, again depending on characteristics of the casing 12 and/or liner member 18 and other physical factors, may be a shorter perforation tunnel 30*b* that is closer to a threshold distance (e.g., 60-90 cm deep) but with a wider diameter (e.g. between about 1 cm and about 1.3 cm).

Referring now to FIG. 2C, a side cross-sectional view of a combination jet shaped charge 10*c* is shown. In this case, the liner member 18*c* may be of a thickness, density, materials and other characteristics similar to either of the deep penetrating liner member 18*a* or wide liner member 18*b* types described above. However, the combination liner member 18*c* of FIG. 2C is of a uniquely tailored non-uniform morphology. Thus, a combination jet 20*c* may ultimately be formed such that the perforation tunnel 30*c* which is formed is also of a uniquely tailored morphology.

Accordingly, FIGS. 2A-2C show that altering physical properties (e.g., density) of the liner member 18 adjusts the shape of the resulting jet 20. That is, by altering the explosive component 16, the liner member 18, and/or mass distributions of an axisymmetric shaped charged design, the charge may be converted to an alternate symmetry. It is presently recognized that for cutting control lines, it may be advantageous to use a shaped charge having a planar symmetry, whereby mass is added or removed at pole 180 degrees apart. As a result, during jet collapse, the normally axially uniform fast-moving jet is converted to a slower fan-like geometry that cuts the line spanning multiple degrees from the axis of symmetry serves to provide increase coverage of the cutter while still achieving velocities and densities inside the cutting fan, which are comparable to linear slot cutters, but which can utilize existing hardware and manufacturing methods.

Figure 3:
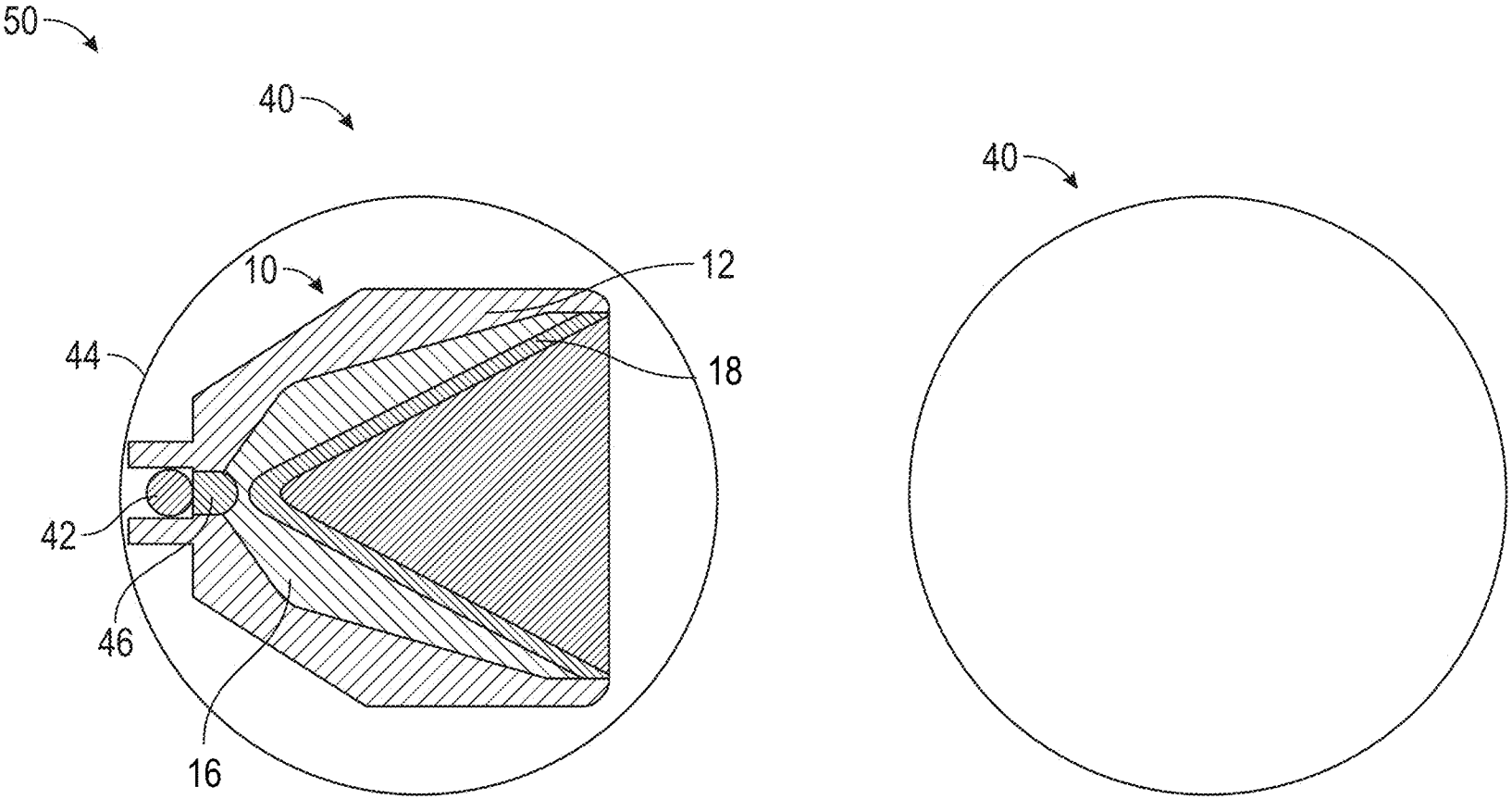
FIG. 3 shows a cross-sectional view of an embodiment of a discrete perforating device, in accordance with aspects of the present disclosure.

As described herein, the disclosed perforating includes a single encapsulated shaped charge that may be deployed through a variety of means, not limited to wireline or tubing. FIG. 3 is a cross-sectional view of an embodiment of a discrete perforating device 40. As described herein, the discrete perforating device 40 may include a shaped charge 10 and an initiating mechanism 42 disposed within a housing 44. As described above, the shaped charge 10 includes a casing 12, an explosive component 16, and a liner member 18. Additionally, the discrete perforating device 40 may include a primer 46 that activates the explosion based on an interaction with the initiating mechanism 42. The initiating mechanism 42 may include control or communication components, as described in more detail with respect to FIG. 5.

In some embodiments, the initiating mechanism 42 may be a chemical activation material, that is generally a material that degrades or is otherwise causes the primer 46 to activate. In some embodiments, the chemical activation material may be a material that degrades upon a pressure reaching a certain pressure threshold. As such, the chemical activation material may collapse or degrade upon the discrete perforating device 40 reaching a certain depth within the well (e.g., the well 24 described in FIGS. 2A-2C). In some embodiments, the chemical activation material may be a material that degrades upon a temperature or pH reaching a certain temperature or pressure threshold.

In some embodiments, multiple discrete perforating devices 40 may be deployed as a perforating device system 50. In general, the perforating device system 50 may include multiple, separate discrete perforating devices 40. As referred to herein, "discrete perforating devices" refers to discrete perforating devices 40 that are spatially distinct, not linked, or directed physically coupled via an external component, such as a rod, an adhesive, a perforating gun, a chain, and the like. As such, although in certain instances, multiple perforating devices may be in contact with each other, the perforating devices are each separate discrete perforating devices 40 because their respective housings 44 are not linked. In any case, each discrete perforating device 40 may be deployed separately or otherwise as independent discrete perforating devices 40 with a respective shaped charge 10. In some embodiments, one or more discrete perforating devices may be activated (e.g., via the initiating mechanism 42) via a control signal. That is, the discrete perforating devices 40, although separate and discrete, may be activated substantially simultaneously, individually, or in bursts (e.g., activating initiating mechanisms 42 of two or more discrete perforating devices 40).

As shown, the housing 44 surrounds and encloses the shaped charge 10, the initiating mechanism 42, and the primer 46. Moreover, the housing 44 may be curved, have a substantially spherical shape, or be a solid of revolution such that the housing 44 is capable of rotating about one or more axes. It is presently recognized that forming the housing 44 to be substantially round may aid the discrete perforating device 40 to traverse within the well 24 since the discrete perforating device 40 is capable of rolling. While the discrete perforating device 40 is shown as a sphere, it should be noted that the discrete perforating device 40 may have other suitable shapes that are capable of rolling (e.g., a solid of revolution), such as a cylindrical shape, an ovoid shape, and the like. As such, the discrete perforating device 40 may be capable of rolling via a curved outer surface 47 about one, two, or three axes while the discrete perforating device 40 is disposed downhole. In some embodiments, the discrete perforating device 40 may have an anisotropic shape, such as a pyramidal shape, such that the discrete perforating device 40 preferentially rests in a particular orientation. This embodiment and other embodiments are described in more detail in FIG. 4.

Figure 4:
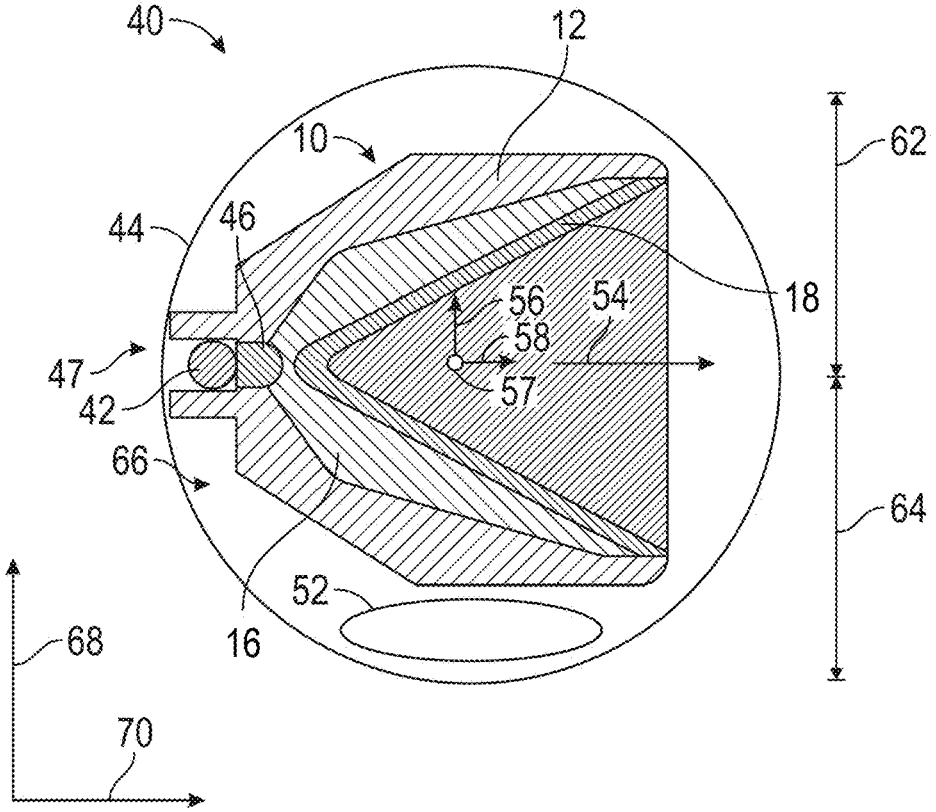
FIG. 4 shows a cross-sectional view of an embodiment of the discrete perforating device with a directional biasing feature, in accordance with aspects of the present disclosure.

FIG. 4 shows a cross-sectional view of the discrete perforating device 40 that includes a directional biasing feature 52. In general, the directional biasing feature 52 may increase the weight or density in a portion of the discrete perforating device 40, and thus, cause the orientation of the perforating device to roll (e.g., about the axes 56, 57, and 58) along the curved outer surface 47 such that its shooting orientation 54 may become aligned in a desired direction and/or preferentially rests in a particular orientation. For example, if the housing 44 is cylindrical, the discrete perforating device 40 may rotate about the axis 57. However, if the housing 44 is spherical, the discrete perforating device 40 may rotate about any of the axes 56, 57, and 58. In any case, it may be advantageous such that the discrete perforating devices 40 has its shooting orientation 54 (e.g., corresponding to the direction where a jet 20 is produced) aimed at a predetermined direction with relation to the casing/formation.

To facilitate the directional biasing, the directional biasing feature 52 may be located in the housing 44 or the casing 12. In some embodiments, the directional biasing feature may be included in the top portion 62 (e.g., top half, top third, top quarter) or the bottom portion 64 (e.g., bottom half, bottom third, bottom quarter) of the inner volume 66 of the housing 44. In general, the top portion 62 and the bottom portion 64 are described with respect to the longitudinal axis 68. However, it should be noted that the descriptions of the top portion 62 and/or the bottom portion 64 may also apply to a directional biasing feature 52 disposed within different portions along the lateral axis 70. In some embodiments, the directional biasing feature 52 may be included within the bottom portion 64 that is 10% or less, 20% or less, 25% or less, 30% or less, 40% or less, or 50% or less of the inner volume 66 of the housing 44. As such, the directional biasing feature 52 may cause the bottom portion 64 to have a relatively higher density than the top portion 62. Accordingly, the discrete perforating device 40 may preferentially roll when the bottom portion 64 (e.g., that includes the directional biasing feature 52) is on top of the top portion 62 (e.g., relative to the longitudinal axis 68), such that, ultimately, the bottom portion 64 is below the top portion 62. In some embodiments, the directional biasing feature 52 may have a density that increases the density of the bottom portion 64 such that it is greater than the top portion 62, such as greater than or equal to 0.5%, 1%, 5%, 10%, or 15% than the top portion 62. Although described as being part of the inner volume 66, it should be noted that the directional biasing feature 52 may be coupled to an inner wall (not shown) of the housing 44.

It should be noted that the directional biasing feature 52 may be in one or more positions within the top portion 62 and/or bottom portion 64 to bias the discrete perforating device in a particular direction. For instance, in a horizontal well, it may be advantageous to include a directional biasing feature 52 in the bottom portion 64 such that the shooting orientation 54 of the shaped charge 10 of the discrete perforating device 40 is oriented to shoot in the upper section of the well or on the lower section of the well or even at a desired angle. On a vertical or deviated well, the shooting orientation 54 of the shaped charge 10 may be oriented sideways in order to ensure casing/formation penetration rather than being shot axially in the well direction. On other applications the discrete perforating device 40 can be configured to shoot down on a vertical or deviated well to target specific completion parts.

In some embodiments, the directional biasing feature 52 may include an additional material added within the casing. For example, the directional biasing feature 52 may be disposed outside of, around, or otherwise separate from the shaped charge 10 of the perforating device. As such, the directional biasing feature 52 may form an increased density portion within the top portion 62 or bottom portion 64. At least in some instances, placing the directional biasing feature 52 sufficiently away from (e.g., 1 cm, 2 cm, or 3 cm) the shaped charge 10 may prevent the density of the directional biasing feature 52 from affecting the jet (e.g., the jet 20) produced by the shaped charge 10 upon detonation.

In some embodiments, the directional biasing feature 52 may include a void, an air pocket, or otherwise a volume having a lower density compared to the remaining volume of the discrete perforating device 40. As such, the directional biasing feature 52 may form a reduced density portion within the top portion 62 or bottom portion 64. In some embodiments, the directional biasing feature 52 may be disposed in the top portion 62. As such, the discrete perforating device 40 may preferentially roll when the top portion 62 (e.g., that includes the directional biasing feature 2) is below the bottom portion 64 (e.g., relative to the longitudinal axis 68), such that, ultimately, the top portion 62 is above the bottom portion 64.

Figure 5:
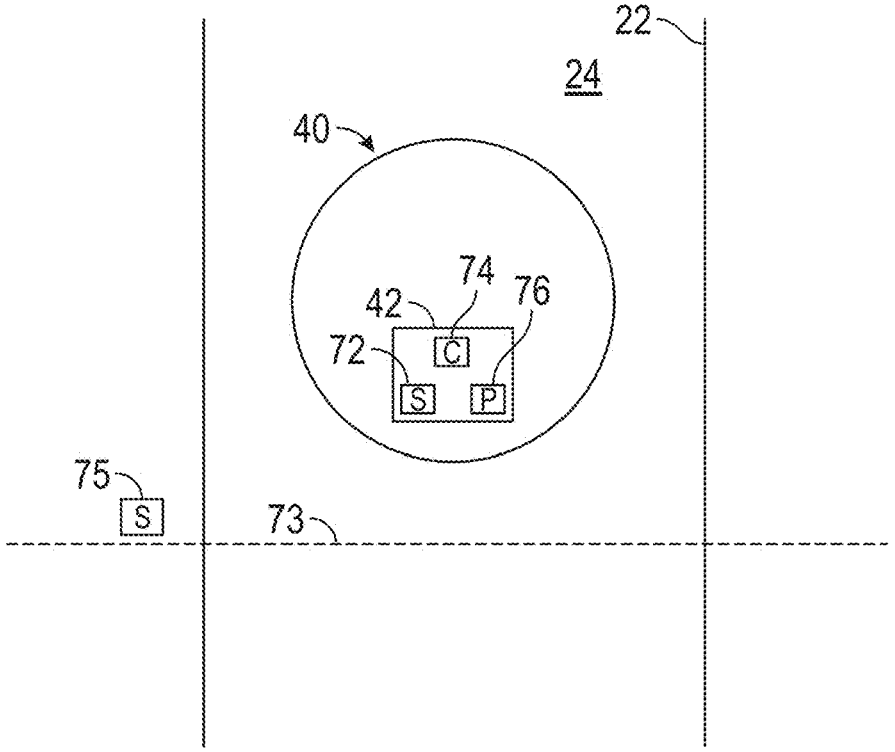
FIG. 5 shows a cross-sectional view of an embodiment of the discrete perforating device with a position sensor being used in a well, in accordance with aspects of the present disclosure.

As described herein, the initiating mechanism 42 may include control or communication components and/or sensors, as opposed to a reactive material. To illustrate this, FIG. 5 shows a cross-sectional view of a discrete perforating device 40 disposed within a well 24 defined by a casing 22. In this embodiment, the initiating mechanism 42 includes a sensor 72, a communication component 74, and a processor 76. The sensor 72 may be a positional sensor that acquires or measures data indicating a location (e.g., positional data) of the discrete perforating device 40 within the well 24. For example, the sensor 72 may be a depth correlation device, such as a positional sensor, depth sensor, or proximity sensor. The initiating mechanism 42 may also include a memory that stores instructions that are executable by the processor 76 to perform operations such as receiving data indicating the location of the discrete perforating device 40, determining whether the discrete perforating device 40 is at a location corresponding to where it is desirable to perform a perforation operation, and then the processor 76 may cause the primer 46 to activate the explosive component 16 within the discrete perforating device 40. As such, in an embodiment when the initiating mechanism 42 also includes a sensor 72, when the sensor 72 measures data indicating that a first discrete perforating device 40 has reached (e.g., is within a threshold range) of a target location 73 (e.g., where a sensor 75 may be located), the initiating mechanism 42 of the first discrete perforating device 40 may activate, causing the first perforating device to explode and form a jet 20. Additionally, and prior to activation of the initiating mechanism of the first perforating device, the communication component 74 of the first discrete perforating device 40 may communicate a control to signal to a circuitry of a second discrete perforating device 40, causing the second discrete perforating device 40 to explode and form a jet 20.

In some embodiments, the processor 76 may receive input via the communication component 74 from a surface computing device. In some embodiments, the discrete perforating device 40 may transmit a control signal to a processor 76 of a second discrete perforating devices 40 that cause the second discrete perforating devices 40 to produce a jet 20. In this way, the initiating mechanism 42 may provide an operator with an ability to control multiple discrete perforating devices 40.

In some embodiments, the discrete perforating device 40 may or may not contain a depth correlation device to identify the position of the discrete perforating device 40 within the well in order to actuate the charge at a desired depth measured by itself. When a depth correlation device is not used in the discrete perforating device 40 the discrete perforating device 40 may be positioned in the desired depth of the well mechanically by knowing the depth of the bottom of the well and pumping positioning balls of known diameter, without a shaped charge, ahead of the perforating ball. For example if the bottom of the well is 20,100 ft and the perforating is desired at 20,000 ft, a number of positioning balls, for instance 300 balls of 4 in diameter (4 in×300 balls=1,200 in =100 ft) may be added. Although described as being 4 inches, in some embodiments the discrete perforating device 40 may have a diameter less than about 6 inches and greater than about 0.1 inches. The lower bound of the diameter may be about half the diameter of a casing 22. In some embodiments, the discrete perforating device 40 may have a diameter less than or equal to about 10, 9, 8, 7, 6, 5, 4, or 3 inches.

Figure 6:
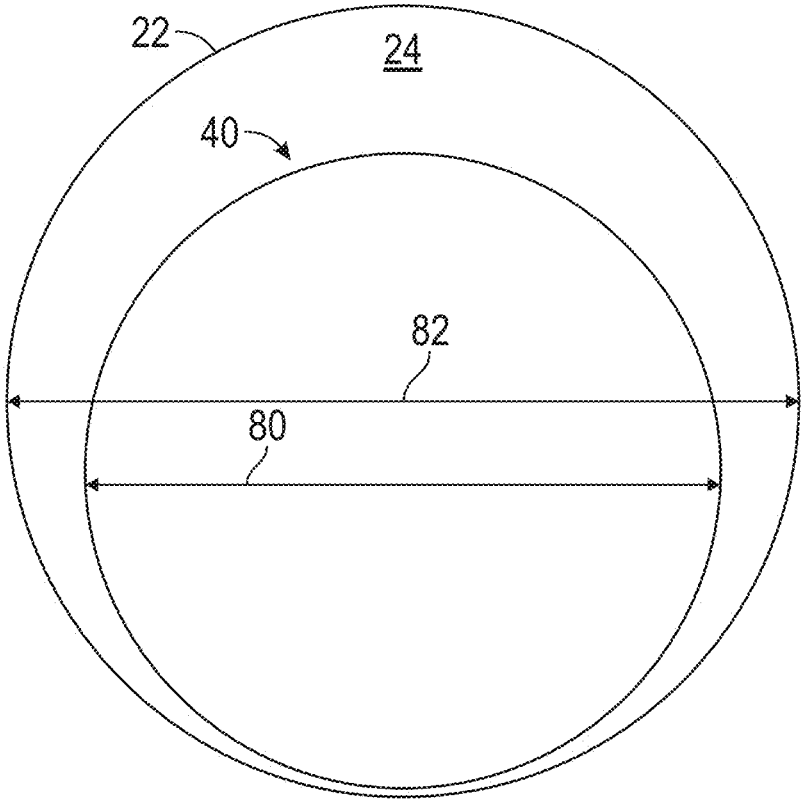
FIG. 6 shows a cross-sectional view of an embodiment of the discrete perforating device used in a well, in accordance with aspects of the present disclosure.

It should be noted that the size of the discrete perforating device 40 should be a suitable size for the casing. This is generally illustrated in FIG. 6, which shows a discrete perforating device 40 within a casing 22. The discrete perforating device 40 has a diameter 80 and the casing 22 has a diameter 82. To avoid the discrete perforating devices 40 from moving or otherwise shifting in the casing 22, it may be advantageous such that the diameter 80 is greater than 50% of the diameter 82. As described above, knowing the diameter 80 of the discrete perforating device 40 may facilitate locating the discrete perforating device 40. For example, if the diameter 80 is 4 inches and the discrete perforating device 40 is disposed within a 5½ 20 #casing, 600 balls may span a 200 ft section of a single stage of the case. As another non-limiting example, if the diameter 80 is 3 inches and the discrete perforating device 40 is disposed within a 5½ 20 #casing, 800 balls may span a 200 ft section of a single stage of the case. Accordingly, the diameter 80 of the discrete perforating device 40 may be less than or equal to 6 inches, less than or equal to 5 inches, less than or equal to 4 inches, or less than or equal to 3 inches.

Figure 7:
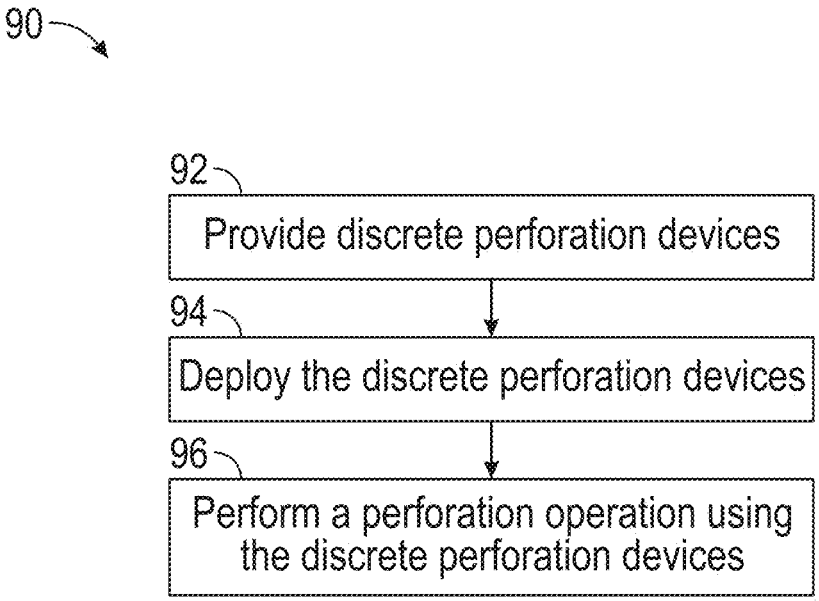
FIG. 7 shows a flow diagram of a method for assembling a multi-part shaped charge liner, in accordance with aspects of the present disclosure.

FIG. 7 shows an example process 90 for performing perforation operations using the disclosed discrete perforating devices 40. At block 92, the process 90 includes providing the discrete perforating devices 40. In general, providing the discrete perforating devices 40 may include forming the discrete perforating devices 40. For example, forming the discrete perforating devices 40 may include disposing a shaped charge 10 within the housing 44. In embodiments where the casing 12 and housing 44 are unibody structure, block 92 may include arranging the liner member 18 and the explosive component 16 within the housing 44. For example, the housing 44 may include an interior surface that complements a desired shape of the liner member 18. As such, the liner member 18 may be provided to the interior surface. Then, the explosive component 16 may be provided to the inner surface of the liner member 18, in a generally similar arrangement as shown in FIG. 3.

At block 94, the process 90 includes deploying the discrete perforating devices 40. As described herein, the discrete perforating devices 40 may be deployed in a variety of means, such as pumping or using traditional conveyance methods such as: Wireline Perforating, Wireline Pump Down Perforating, Slickline Perforating, Coil Tubing Perforating or Tubing Conveyed (TCP). In some embodiments, deploying the discrete perforating devices 40 may include activating a sensor 72 disposed within the discrete perforating device 40.

At block 96, the process 90 includes performing a perforation operation using the discrete perforating devices 40. In general, the perforation operation may include the initiating mechanism 42 initiating the explosion (e.g., via a primer 46) of the shaped charge 10 in the discrete perforating device 40 to produce a jet 20. In some embodiments, the perforation operation may be performed when conditions within the well 24 are within a suitable range. For example, in an embodiment where the initiating mechanism 42 is pH, pressure, temperature sensitive, or a combination thereof, the perforation operation may initiate upon the discrete perforating device 40 reaching a target location. In some embodiments, performing the perforation operation may include communicating (e.g., via a surface computing device) a control signal to the communication component 74 of the discrete perforating devices 40 that causes the discrete perforating device 40 to produce a jet 20.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A discrete perforating device, comprising:

a single shaped charge comprising a casing, an explosive component, and a liner member;

an initiating mechanism configured to initiate detonation of the explosive component of the single shaped charge; and a round housing that encapsulates the single shaped charge and the initiating mechanism, the round housing being configured to roll in a wellbore, and the round housing having a ball-shape, an ovoid shape, an ellipsoidal shape, or a spherical shape.

2. The discrete perforating device of claim 1, wherein the casing and the round housing are a unibody structure.

3. The discrete perforating device of claim 1, comprising a directional biasing feature configured to bias the round housing to roll toward a particular direction of a shooting orientation of the single shaped charge in the wellbore.

4. The discrete perforating device of claim 1, wherein the round housing has the spherical shape.

5. The discrete perforating device of claim 1, wherein the round housing is configured to roll about a plurality of axes, and at least one axis of the plurality of axes is crosswise to a longitudinal axis of the wellbore.

6. The discrete perforating device of claim 1, wherein the round housing has a curved outer surface configured to roll along the wellbore in a direction along a longitudinal axis of the wellbore.

7. The discrete perforating device of claim 1, wherein the initiating mechanism comprises a chemical activation feature configured to initiate the detonation in response to conditions in the wellbore.

8. The discrete perforating device of claim 7, wherein the chemical activation feature is configured to initiate the detonation in response to degradation based on a temperature, a pressure, a pH, or a combination thereof, applied to the chemical activation feature by the conditions in the wellbore.

9. The discrete perforating device of claim 1, comprising one or more positional sensors, wherein the initiating mechanism is configured to activate based on positional data acquired by the one or more positional sensors.

10. A perforating device system, comprising:

a plurality of discrete perforating devices, each comprising:

a round housing having a curved outer surface that encapsulates a single shaped charge having an explosive component positioned within an interior volume of the round housing, an initiating mechanism configured to activate the explosive component, and a directional biasing component, wherein the round housing is configured to roll along the curved outer surface in a wellbore, and the round housing has a ball-shape, an ovoid shape, an ellipsoidal shape, or a spherical shape, and wherein the directional biasing component is configured to bias the round housing to roll along the curved outer surface toward a particular direction of a shooting orientation of the single shaped charge in the wellbore.

11. The perforating device system of claim 10, wherein each of the plurality of discrete perforating devices comprises a communication component, and a first device of the plurality of discrete perforating devices is configured to communicate a control signal to one or more second devices of the plurality of discrete perforating devices to activate the explosive component of the one or more second devices.

12. The perforating device system of claim 10, wherein the directional biasing component comprises a variation in a density about an axis of rotation of at least one of the plurality of discrete perforating devices.

13. The perforating device system of claim 12, wherein the variation in the density is configured to bias the shooting orientation in the particular direction relative to a formation surrounding the wellbore.

14. The perforating device system of claim 10, wherein the round housing is configured to rotate in any rotational direction in the wellbore.

15. The perforating device system of claim 14, wherein a maximum dimension of the round housing is less than an inner diameter of the wellbore.

16. The perforating device system of claim 15, wherein the round housing is configured to rotate about a plurality of axes, at least one axis of the plurality of axes is crosswise to a longitudinal axis of the wellbore, the curved outer surface of the round housing is configured to roll along an interior surface of the wellbore in a direction along the longitudinal axis of the wellbore, the round housing has the spherical shape, and the maximum dimension is a diameter of the spherical shape.

17. A method, comprising:

providing a plurality of discrete perforating devices, wherein each discrete perforating device comprises a round housing that holds a single shaped charge having an explosive component, the round housing being configured to roll in a wellbore, and the round housing having a ball-shape, an ovoid shape, an ellipsoidal shape, or a spherical shape;

deploying the plurality of discrete perforating devices within the wellbore; and performing a perforation operation subsequent to deploying the plurality of discrete perforating devices within the wellbore.

18. The method of claim 17, comprising:

rotating the round housing about a plurality of axes, wherein at least one axis of the plurality of axes is crosswise to a longitudinal axis of the wellbore; and rolling a curved outer surface of the round housing along an interior surface of the wellbore in a direction along the longitudinal axis of the wellbore.

19. The method of claim 18, wherein deploying the plurality of discrete perforating devices within the wellbore comprises pumping the plurality of discrete perforating devices into the wellbore.

20. The method of claim 19, further comprising pumping a plurality of positioning balls into the wellbore prior to pumping the plurality of discrete perforating devices into the wellbore.

* * * * *